US007004824B1

(12) United States Patent
Madanshetty

(10) Patent No.: US 7,004,824 B1
(45) Date of Patent: Feb. 28, 2006

(54) METHOD AND APPARATUS FOR DETECTING AND DISPERSING AGGLOMERATES IN CMP SLURRY

(76) Inventor: Sameer I. Madanshetty, 6923 Redbud Dr., Manhattan, KS (US) 88603

( * ) Notice: Subject to any disclaimer, the term of this patent is extended or adjusted under 35 U.S.C. 154(b) by 0 days.

(21) Appl. No.: 10/804,125

(22) Filed: Mar. 19, 2004

Related U.S. Application Data

(60) Provisional application No. 60/455,576, filed on Mar. 19, 2003.

(51) Int. Cl.
*B24B 1/00* (2006.01)

(52) U.S. Cl. ..... 451/60; 451/5; 451/6; 451/8; 451/10; 451/36; 451/88; 451/99; 451/287; 451/289; 451/446; 451/910

(58) Field of Classification Search ..... 451/5, 451/6, 8, 10, 36, 60, 88, 99, 287, 289, 446, 451/910
See application file for complete search history.

(56) References Cited

U.S. PATENT DOCUMENTS 5,895,550 A * 4/1999 Andreas ..... 156/345.12
6,592,708 B1 * 7/2003 Vanell ..... 156/345.1

* cited by examiner

*Primary Examiner*—Lee D. Wilson
*Assistant Examiner*—Shantese McDonald
(74) *Attorney, Agent, or Firm*—McIntyre Harbin & King, LLP

(57) ABSTRACT

A method and apparatus of in situ monitoring and dispersing unwanted particles in slurry used during CMP polishing. The method includes providing a slurry path, applying to the slurry path a microcavitation field of a first level to detect particles of a predetermined size, applying to the slurry path a microcavitation field of a second level that is capable of dispersing said particles, and after the second applying step, feeding the slurry to a CMP polishing unit. Particle size may be detected and/or the microcavitation field strength may be set according to particle size. In addition, field strength may be calibrated according to levels determined by polystyrene control particles of a known size and/or concentration. A single or dual transducer may apply the microcavitation.

16 Claims, 4 Drawing Sheets

METHOD AND APPARATUS FOR DETECTING AND DISPERSING AGGLOMERATES IN CMP SLURRY

CROSS-REFERENCE TO RELATED PATENT APPLICATION

This invention claims the benefit of Provisional Application Ser. No. 60/455,576 entitled Method and Apparatus for Detecting and Dispersing Agglomerates in CMP Slurry, filed Mar. 19, 2003 in the name of the same inventor hereof.

BACKGROUND

This invention relates to semiconductor wafer processing, but more specifically, to a method and an apparatus to detect and disperse agglomerates prior to chemical mechanical planarization ("CMP") polishing.

Present day wafer planarization is typically accomplished using a CMP slurry of nanometer-sized particles to polish the surface of a wafer before applying circuit patterns. A CMP slurry is 99.99% comprised of nanoparticles having a mean diameter less than 50 nanometers ("nm"). Unwanted agglomerates in the slurry typically exceed 300 nm. A typical slurry composition varies between 2% to 15% by weight (copper CMP slurries are less dense than oxide CMP slurries).

The wafer polishing process is generally carried out for each layer of a multiplayer semiconductor device. Scratching or other damage occurs to the wafer during polishing when slurry particles or agglomerate exceed a given size. Thus, detecting large agglomerates or non-uniform particles in the CMP slurry will make polishing more error-free and efficient, which increase production yield.

Thus, it is an objective of the present invention to detect and/or disperse agglomerates in a holding tank or situ before supplying the slurry to polishing pads of a CMP polisher by employing acoustic microcavitation both to detect unwanted particles or agglomerates and to disperse or breakup such particles or agglomerates. An apparatus to generate such acoustic microcavitation fields is shown, for example, in commonly-owned U.S. Pat. No. 6,395,096 entitled Single Transducer ACIM Method and Apparatus, incorporated herein.

Current CMP slurry monitoring systems include light scattering methods which generally cannot be employed in opaque media or to detect particles smaller than 60 nm. A PSS (Particle Sizing Systems) instrument, for example, relies on light scattering signatures from particles and laboriously requires that a slurry sample be highly diluted and flowing through a small capillary prior to measurement. A departure from light scattering or other methods used by instruments commercially available from Colloidal Dynamics, Inc. and Matec, Inc. Such devices are based on electroacoustic effect in response to high frequency (in excess of 100 MHz) electromagnetic waves. Oscillations are excited in colloidal dispersions, which collectivity emit sound that is detected and size-inferred.

No prior system precisely detects single particles as distinguished from the sizing of a collectivity of particles. Further, no prior system can truly monitor slurries in-line at the point of use, as they are invariably able to process only diluted samples, off-line.

The present invention, on the other hand, may provide real-time, in-line, in-liquid particle detection, counting, and characterization. This contrasts with X-ray diffraction (requiring special sample preparation) or SEM analysis (which does not work in water). The present invention requires no optical transparency, is not limited to small sample volumes, and may identify particles/agglomerates selected for size from a background of other particulates. The present invention enables real-time, in situ preclusion of even a single large agglomerate (>300 nm) from a CMP polishing pad, and may comminute agglomerates in a 70 milliliters or so reservoir or slurry stream just before being fed to the polishing pad.

SUMMARY

According to a first aspect of the invention, there is provided a method of in situ monitoring and dispersing unwanted particles in slurry used during CMP polishing that comprises providing a slurry path, applying to the slurry path a microcavitation field of a first level to detect particles of a predetermined size, applying to the slurry path a microcavitation field of a second level that is capable of dispersing said particles, and after the second applying step, feeding the slurry to a CMP polishing unit. The method may further include detecting particle size after the first applying step and/or setting the energy level of the microcavitation field in the first or second applying steps according to particle size. In addition, the method may optionally include calibrating the energy level according to levels determined by inducing microcavitation using control particles of a known size and/or concentration. A single or dual transducer may apply the microcavitation field.

According to a second aspect of the invention, there is provided a method of dispersing agglomerates in slurry used during CMP polishing comprising applying to the slurry a cavitation field of sufficient level to disperse agglomerates above a predetermined size prior to using the slurry. This aspect may also include detecting particle size of the agglomerates and/or adjusting the energy level of the microcavitation field according to particle size. In addition, this aspect of the invention may include calibrating the energy level according to known energy levels determined by inducing microcavitation with particles of a known size and/or concentration in a liquid insonification medium.

In yet a further aspect of the invention, there is provided an apparatus to carry out in situ monitoring and dispersion of particles in slurry used during CMP polishing that comprises a conduit to provide a slurry path, a transducer that applies to the slurry path a cavitation field of a first level to enable detection of particles of a predetermined size and a cavitation field of a second level that is capable of dispersing the particles, and a CMP polishing unit that receives the slurry after being subjected to the cavitation field. The apparatus may further include a detector to detect particle size based on the first level of the cavitation field, as well as a controller to set the level of the first or second energy levels according to particle size. The apparatus may also include a calibration unit to determine the energy level according to levels of induced microcavitation using particles of a known size and/or concentration in a liquid insonification medium. The transducer may comprise a first transducer to produce a cavitation field of the first level and a second transducer to produce a cavitation field of the second level.

A further aspect of the invention comprises a device to disperse agglomerates in CMP slurry simply comprising a reservoir containing CMP slurry and a transducer to produce a cavitation field within the reservoir having an intensity sufficient to induce cavitation and disperse agglomerates above a predetermined size. The device may also include a detector to detect particle size, or a controller to set an energy level of said cavitation field according to particle size. A calibration unit may also be included to calibrate the intensity according to known energy levels determined by inducing microcavitation using particles of a known size and/or concentration in a liquid insonification medium. The transducer comprises a first transducer to detect particles and/or a second transducer to disperse particles.

Other aspects and features of the invention will become apparent upon review of the following description taken in connection with the accompanying drawings. The invention, though, is pointed out with particularity by the appended claims.

DESCRIPTION OF ILLUSTRATIVE EMBODIMENT

Figure 1:
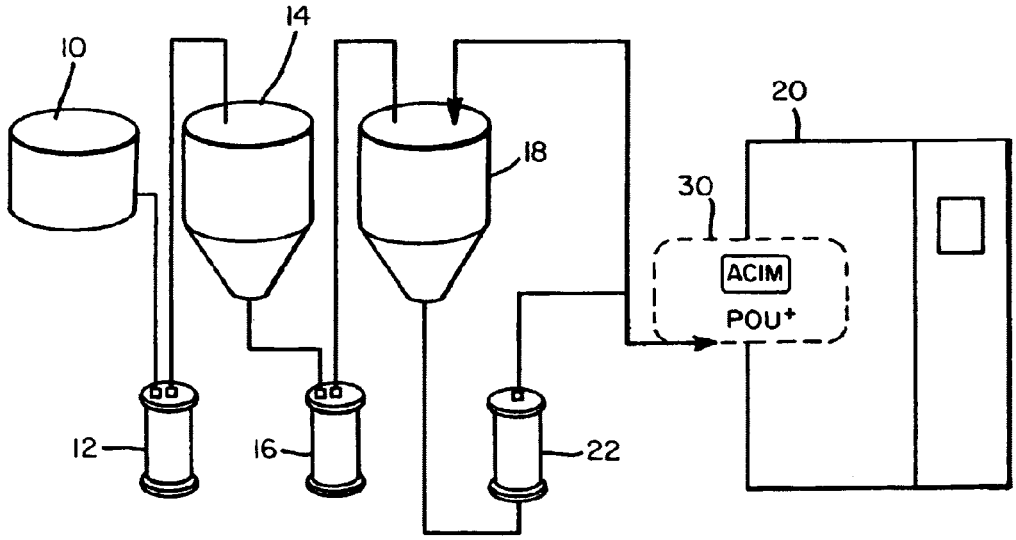
FIG. 1 shows a conventional CMP polishing unit that has been modified with an in situ agglomerate detection and dispersion according to the present invention.

FIG. 1 shows a prior art CMP polishing unit that may be modified according to the present invention. The polishing unit typically includes a slurry container 10 that supplies a first filter 12 before being fed to dilution tank 14 where the desired slurry concentration is achieved. A post dilution filter 16 removes unwanted particles prior to filling a day tank 18 that is used during production to supply a polishing unit 20 through a loop filter 22. Loop filter 22 recirculates used slurry from polishing unit 20. The prior art unit of FIG. 1 is shown to be modified with a point-of-use (POU) slurry monitoring and dispersing unit 30 of one aspect of the present invention.

In the detection method and apparatus of the present invention, a bubble formed by the particle rather than the particle itself is detected, i.e., scattering from an air bubble created at a particle site is measured instead of pulse-echo backscattering. As a result of strong density and compressibility contrast for air bubbles in water (density ratio of 0.0012 and compressibility ratio of 19000), the scattering from an air bubble or empty void is around 80 dB greater than that from a small particle of the same volume, which provides a signal enhancement of a factor of 10,000 (contrasted with optical scattering from bubbles being only two times the scattering from particles). Since microcavitation coaxes a bubble at each particle site, the inventive method and apparatus may detect individual particulates.

Figure 2:
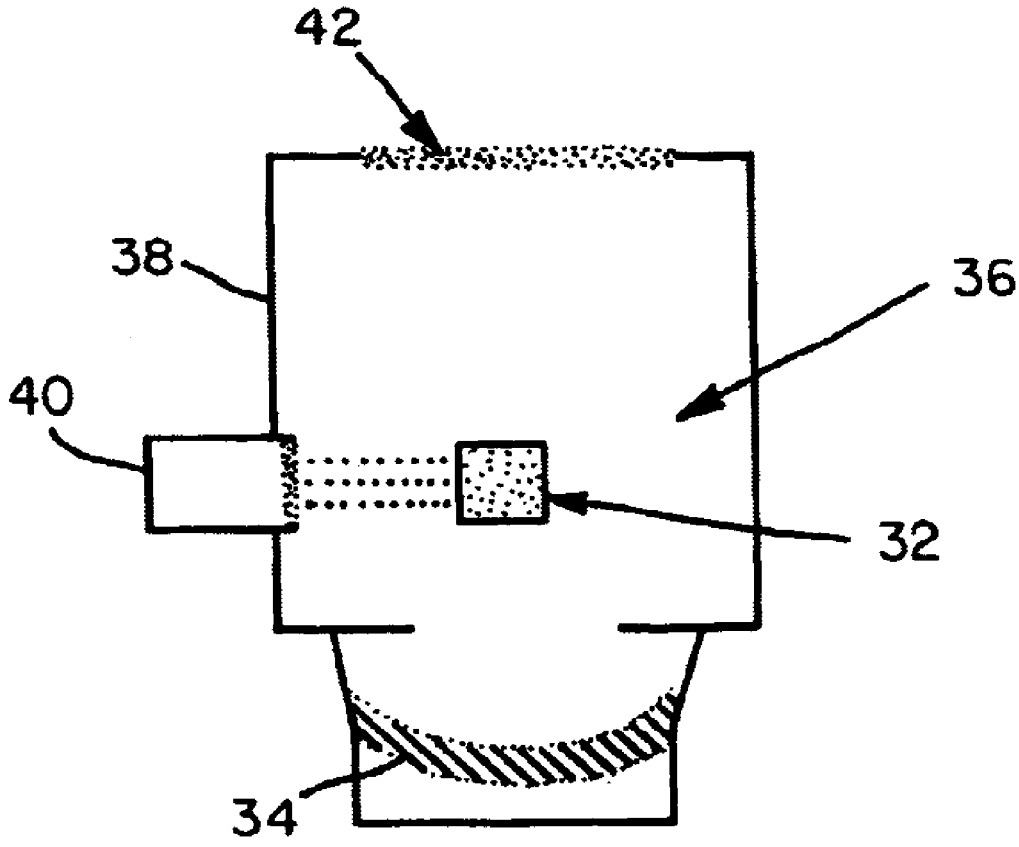
FIG. 2 depicts an exemplary slurry monitoring and dispersion unit according to one aspect of the present invention.

FIG. 2 illustrates a physical arrangement that might be used to detect and disburse particles or agglomerates in POU 30. Slurry passes through a Pyrex tube 32 (vertically into the paper) just prior to being fed the polishing head of unit 20. Tube 32 is acoustically coupled to a transducer 34 via a coupling medium 36 that fills a containment chamber 38. The coupling medium preferably comprises dionized (DI) water. A detector 40 delivers acoustic energy to the coupling fluid, which, in turn, passes through the walls of Pyrex tube 32 to effect detection bubbles produced during cavitation induced by transducer 34. Acoustic field energy propagates to the slurry inside tube 32 from transducer 34 from through medium 36. In the particular embodiment shown, the containment chamber 38 further includes an acoustically transparent diaphragm 42 to prevent reflections in the chamber that might interfere with detector 40 or standing waves that might interfere with transducer 34. Diaphragm 42 is not needed when transducer 34 is operated in a pulsed excitation mode.

Figure 3:
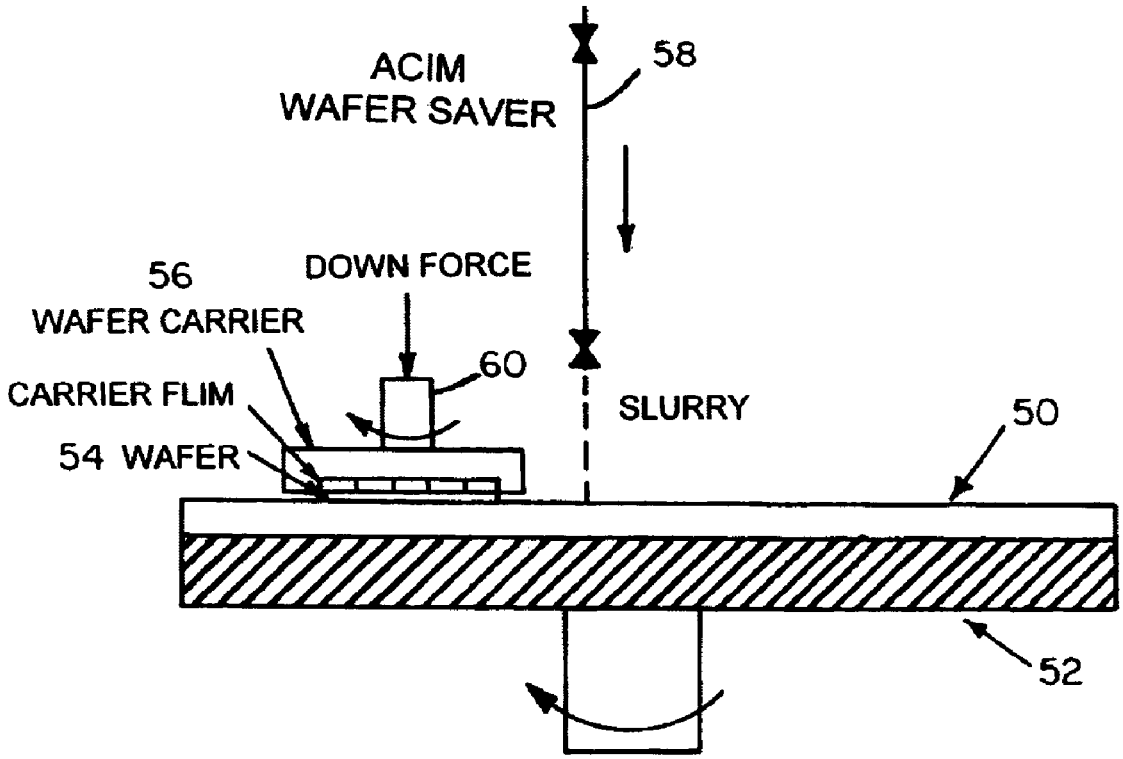
FIG. 3 shows a slurry polishing head of a prior art unit that may utilize slurry monitored and dispersed according to various aspects of the present invention.

FIG. 3 depicts a CMP tool including a polishing pad 50 that is rotated by platen 52. During polishing, wafer carrier 56 holds wafer 54 against polishing pad 50 during its rotation about platen 52. A slurry source form tube 58 feeds slurry upon pad 50 in the direction shown by 59. The slurry is then carried radially outwardly on pad 50 to establish a slurry film between wafer 54 and pad 50. Simultaneously, the wafer 54 is rotated about its own shaft 60, which is coupled to the wafer carrier 56. The polishing process typically lasts about one minute or less during which about seventy to one hundred milliliters of slurry are pumped to the slurry pad 54.

Figure 4A:
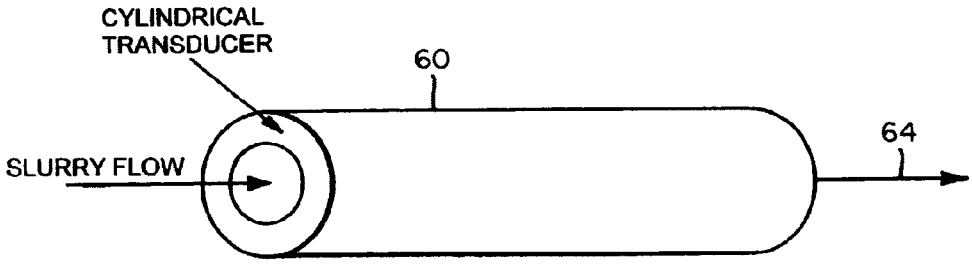
FIGS. 4A and 4B show an alternative embodiment of a transducer that may be used to detect and/or disperse agglomerates according to an aspect of the present invention.
Figure 4B:
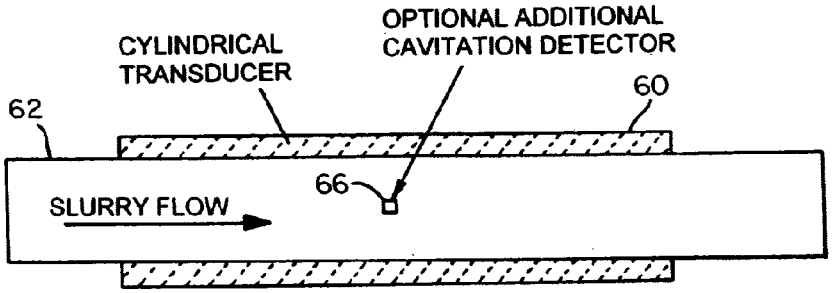

FIGS. 4A and 4B show an alternative arrangement where an annular shaped transducer 60 encircles a slurry tube to induce cavitation in a slurry flow path 64 through tube 62. In one practicable embodiment, the slurry flowing through a Pyrex tube that has an inside diameter of 1.0 centimeter and the transducer extends about two inches along the slurry tube. Transducer 60 and the associated driver and detection circuits may be configured in a single transducer arrangement (as described in U.S. Pat. No. 6,395,096) or a dual transducer arrangement (as described in U.S. Pat. Nos. 5,594,165 and 5,681,396). Optionally, a cavitation detector 66 may be embedded inside tube 62 and within the slurry path 64.

Figure 5:
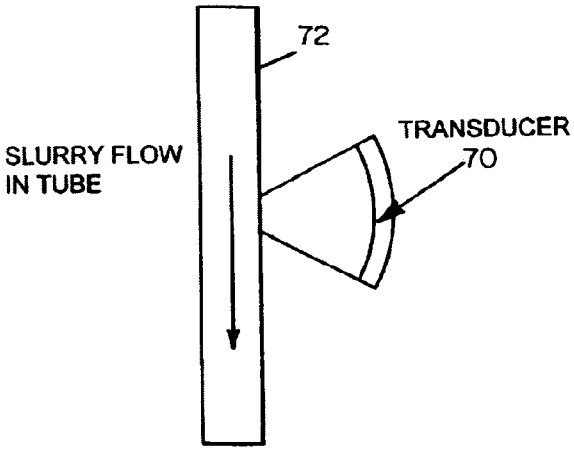
FIG. 5 shows yet a further aspect of the invention depicting a juxtaposed transducer to monitor and disperse agglomerates.
Figure 6:
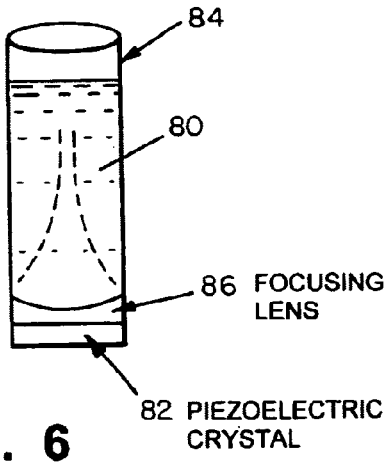
FIG. 6 shows yet another aspect of the present invention that basically includes a holding tank or reservoir in which agglomerates are detected and/or dispersed.

FIG. 5 shows yet another embodiment in which a transducer 70 in juxtaposed relation to tube 72 to induce cavitation in slurry that flows through the tube. FIG. 6 shows yet another arrangement where, rather than in situ monitoring and dispersion, unwanted particles and agglomerates in slurry 80 are monitored and dispersed by a transducer 82 positioned in a tank 84. A focusing lens 86 directs acoustic energy into the slurry 80. After monitoring and dispersing, the slurry is then fed to polishing head (e.g., FIG. 3) of the polishing unit.

During the detection phase, it was found that desired nanometer-sized slurry particle produced cavitation at an acoustic field strength of about 65 to 70 atmospheres whereas unwanted particles and agglomerates of about one micron or more produced cavitation at about 30 to 40 atmospheres. Pure water, for example, cavitates around 100 atmospheres. Unwanted particles were dispersed with a twenty to thirty percent increase in field strength. Thus, in accordance with an important aspect of the invention, particles and agglomerated may be detected and dispersed according to their size.

Calibration was achieved by qualifying a host liquid, i.e., water, for cleanliness. If the water is not clean it would give a low cavitation threshold—the smallest insonification pressure amplitude that brings about cavitation. For proper detection of particles, water threshold was ensured to be higher than that for the particle threshold. This was achieved through careful purification and fine filtration. Measurements were conducted in a cavitation free host with no background cavitation activity below 8.5 MPa peak negative insonification pressure.

An appropriate sample was then filled in a test chamber. Using polystyrene particles as a control substance, particle size and the particle number density were determined. During calibration, the voltage input to the cavitation transducer was gradually ramped up and the first event of cavitation was used to fix the threshold value for that particle size and particle concentration. A minimum number of threshold readings (e.g., thirty) was taken to ensure confidence of the threshold value. The mean value could then be used for threshold settings for the slurry monitoring and dispersion in a practicable embodiment of the invention. Error bars for threshold values were typically within a few atmospheres and the thresholds for different particle sizes used were separated well beyond the error bars. In a slurry mixture, one would monitor particles as large as 1 $\mu$m or 21 $\mu$m in 50 nm slurries, for example.

In one actual implementation, one need not ramp the voltage input to the acoustic transducers. Instead the voltage input is fixed at an insonification level high enough to detect larger particles but low enough to avoid responses from the smaller particles. The actual implementation also involves acoustic fields designed that span the entire range of particles. Any large particle will automatically be in the sensing volume and will automatically respond with cavitation if the insonification level is adequately high.

Both sets of measures-polystyrene particles and silica CMP slurry-reveals that it is possible to detect the sparse presence of large particles mixed in suspensions of fine particles as long as the size difference between particles is large enough such that their microcavitation thresholds do not overlap. Larger particles have lower thresholds. Acoustically, large particles behave essentially independently of the presence of small particles in the suspension. The density of suspensions might limit the cavitation echo signal only if attenuation becomes excessive. In CMP slurries, attenuation is not significant and can be easily accounted for since the feed volume per wafer is only about 100 ml.

What is claimed is:

1. A method of in situ monitoring and dispersing unwanted particles in slurry used during CMP polishing, said method comprising:

providing a slurry path, applying to said slurry path a microcavitation field of a first level to detect particles of a predetermined size, applying to said slurry path a microcavitation field of a second level that is capable of dispersing said particles, and after said second applying step, feeding slurry of said slurry path to a CMP polishing unit.

2. The method of claim 1, further including:

setting an energy level of said microcavitation field in at least one of said first and second applying steps according to particle size.

3. The method of claim 2, further including calibrating said energy level according to levels determined by inducing microcavitation using control particles of a known size and/or concentration.

4. The method of claim 1, wherein said first and second applying steps are performed using a single transducer.

5. A method of dispersing agglomerates in slurry used during CMP polishing comprising detecting a particle size of said agglomerates and applying to said slurry a cavitation field of sufficient level to disperse agglomerates above a predetermined size prior to using said slurry.

6. The method of claim 5, further including setting an energy level prior to said applying step according to particle size.

7. The method of claim 6, further including calibrating said energy level according to known energy levels determined by inducing microcavitation with particles of a known size and/or concentration in a liquid insonification medium.

8. An apparatus to carry out in situ monitoring and dispersion of particles in slurry used during CMP polishing, said apparatus comprising:

a conduit that provides a slurry path, a transducer that applies to said slurry path a cavitation field of a first level to enable detection of particles of a predetermined size and a cavitation field of a second level that is capable of dispersing said particles, and a CMP polishing unit that receives said slurry after being subjected to said cavitation field.

9. The apparatus of claim 8, further including a detector to detect particle size based on the first level of said cavitation field.

10. The apparatus of claim 8, further including:

a controller to set the energy level of at least one of said first and second levels according to particle size.

11. The apparatus of claim 10, further including a calibration unit to determine the energy level according to levels based on induced microcavitation using particles of a known size and/or concentration in a liquid insonification medium.

12. The apparatus of claim 8, wherein said transducer comprises a first transducer to produce a cavitation field of said first level and a second transducer to produce a cavitation field of said second level.

13. A device to disperse agglomerates in CMP slurry comprising:

a reservoir containing CMP slurry, a detector to detect a predetermined size of said agglomerates, and a transducer to produce a cavitation field within said reservoir, said cavitation field having an intensity sufficient to induce cavitation and disperse agglomerates above said predetermined size.

14. The apparatus of claim 13, further including a controller to set an energy level of said cavitation field according to particle size.

15. The apparatus of claim 14, further including a calibration unit to calibrate the intensity according to known energy levels determined by inducing microcavitation using particles of a known size and/or concentration in a liquid insonification medium.

16. The apparatus of claim 13, wherein said transducer comprises a first transducer to detect particles and a second transducer to disperse particles.

* * * * *